United States Patent [19]

Huang

[11] Patent Number: 5,036,872

[45] Date of Patent: Aug. 6, 1991

[54] SELF-OPENING AND SELF-CLOSING UMBRELLA

[76] Inventor: Yueh Huang, P.O. Box 22799, Taipei 10099, Taiwan

[21] Appl. No.: 461,355

[22] Filed: Jan. 3, 1990

[51] Int. Cl.[5] ..... A45B 25/14

[52] U.S. Cl. ..... 135/22; 135/24; 135/40

[58] Field of Search ..... 135/19.5, 22, 24, 25, 135/28, 27, 40, 39

[56] References Cited

U.S. PATENT DOCUMENTS 3,658,077 4/1972 Sato ..... 135/22
4,421,133 12/1983 Huang ..... 135/22

FOREIGN PATENT DOCUMENTS 2218629 11/1989 United Kingdom ..... 135/24

*Primary Examiner*—Henry E. Raduazo

*Assistant Examiner*—Lan Mai

[57] ABSTRACT

An improved self-opening and self-closing umbrella including a canopy, a conventional self-opening and self-closing frame formed of ribs and a telescoping shaft, a handle and an auxiliary mechanism overcomes problems with a conventional self-opening and self-closing umbrella by means of the auxiliary mechanism which comprises a cylindrical tube fixed on the shaft, spring means provided over the shaft in the tube, a hollow push rod provided between the spring means and the handle, locking means provided between the shaft and the tube, two sleeves provided over the shaft and the tube respectively.

The auxiliary mechanism serves to help the umbrella open quickly and fully, close to a condition where the umbrella folds tightly and stands ready for opening again, get its shaft strengthened and be used as a walking stick conveniently.

4 Claims, 6 Drawing Sheets

Pror Art

SELF-OPENING AND SELF-CLOSING UMBRELLA

BACKGROUND OF THE INVENTION

This invention relates to a self-opening and selfclosing umbrella, particularly to an improved self-opening and self-closing umbrella which overcomes several problems with a conventional self-opening and self-closing umbrella as illustrated in U.S. Pat. No. 4421133. Unless these problems are successfully solved, the umbrella can hardly be expected to serve people satisfactorily at a rainy day.

The first problem with a conventional self-opening and self-closing umbrella is that it cannot open quickly and fully when it is quickly raised up from the ground, against which the umbrella has been pushed for opening. 11 is is because a much stronger elastic strength is required of the spring disposed in the middle tube of the shaft the instant when the folded canopy is made to spread, something like a motor car which needs a greater horsepower to start, and then the elastic force of the spring is much diminished by an air pressure or resistance suddenly exerted on the canopy on the other hand. In most cases, the umbrella will stand half opened.

The second problem with a conventional self-opening and self-closing umbrella is that it cannot always close to a condition as planned wherein it folds tightly for convenient carrying and stands ready for opening again. This is also because of the air pressure or resistance now exerted on the inside of the canopy, especially when there is a wind blowing.

The third problem with a conventional self-opening and self-closing umbrella is that the lower inner tube of the telescoping shaft bends easily at the point where it meets the lower end of the middle tube. This is because of the fact that the inner tube is normally relatively weak in structure and that a sudden strong force is always abnormally exerted on that point when the umbrella is not pushed in a proper or perpendicular manner against the ground for opening, as often so with a new user of the umbrella.

Then still another problem with a conventional selfopening and self-closing umbrella is that its handle portion is not fixed with respect to its shaft. The umbrella cannot, therefore, be used as a walking stick.

SUMMARY OF THE INVENTION

The present invention overcomes the problems with a conventional self-opening and self-closing umbrella by providing an improved self-opening and self-closing umbrella which has an auxiliary mechanism incorporated in the umbrella. In the present invention, the auxiliary mechanism serves to help the umbrella open quickly and fully and close to a condition wherein the umbrella folds tightly and stands ready for opening again. Besides, the shaft of the umbrella is strengthened and the umbrella can be used as a walking stick.

DETAILED DESCRIPTION OF THE PREFERRED EMBODIMENTS

Figures 1A, 1B:
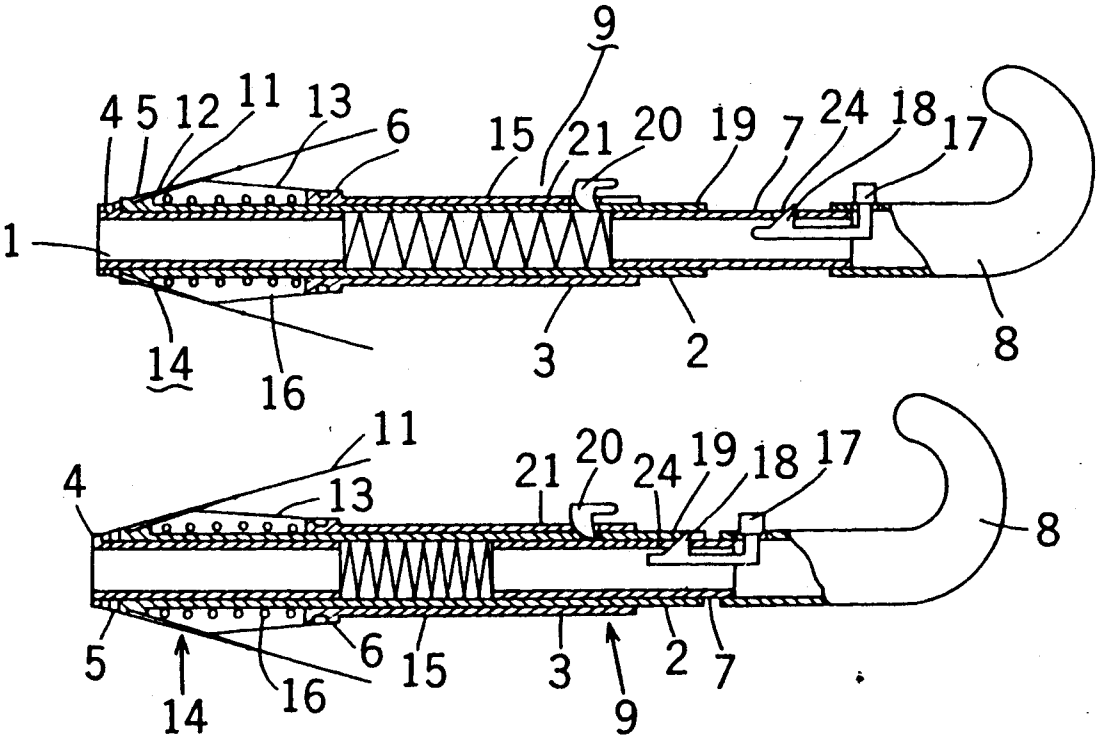
FIG. 1 shows a conventional self-Opening and self-closing umbrella as illustrated in U.S. Pat. No. 4421133.
Figure 2:
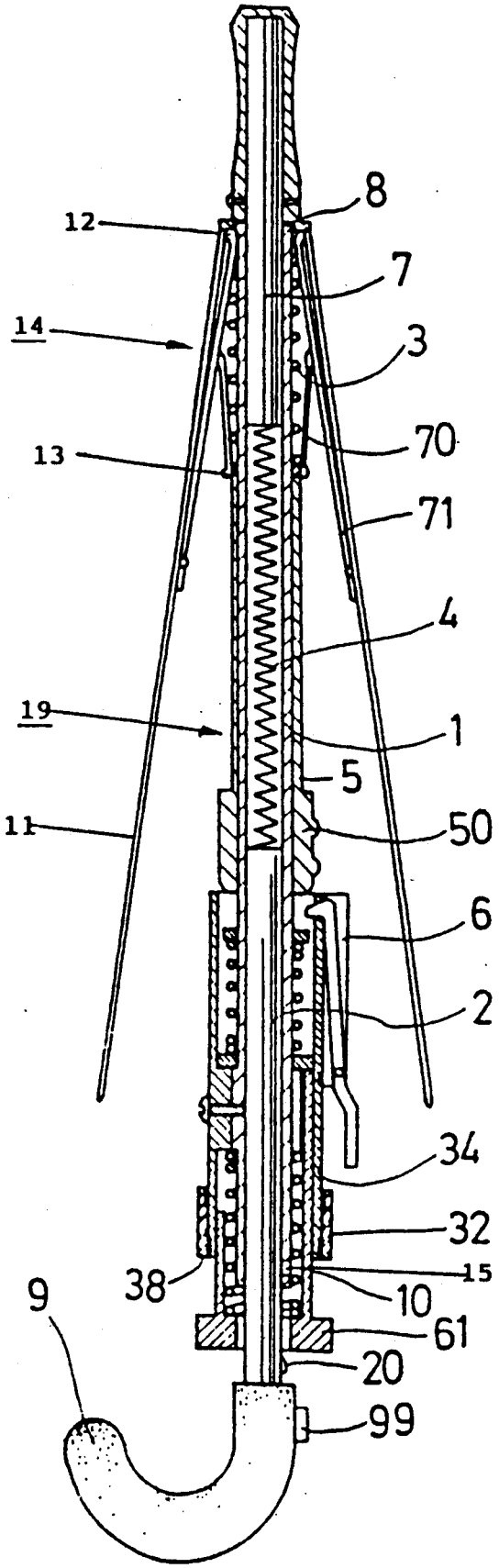
FIG. 2 illustrates the present invention of an improved self-opening and self-closing umbrella.

As shown in FIG. 2, an embodiment of the present invention includes a canopy (not shown), a frame 14, a handle 9 and an auxiliary mechanism 6.

Frame 14 is formed of ribs 11, stretchers 70 and 71, telescoping shaft 19, springs 3 and 4 locking means 62 and 20, and notches 8, 12 and 13. Shaft 19 comprises an outer tube 5, middle tube 1, upper inner tube 7 and lower inner tube 2. Middle tube 1 is slidably disposed within outer tube 5 and upper inner tube 7 and lower inner tube 2 are longitudinally displaced and slidably disposed within middle tube 1.

Between upper inner tube 7 and lower inner tube 2 is a spring 4 abutting against the ends of inner tubes 7 and 2. Notches 8, 12 and 13 are separately provided at the top of tubes 7, 1 and 5 respectively.

A plurality of main ribs 11 are pivotably attached to notch 8 and supported by stretchers 70 and 71 pivotably attached to notches 12 and 13 respectively. Main ribs 11 and stretchers 70 and 71 form a pagoda-shaped frame 14 for supporting the umbrella canopy.

Spring 3 is coaxially disposed over middle tube 1 and contained between notch 12 and notch 13. When compressed, spring 3 biases notches 12 and 13 away from each other so as to exert a closing force on frame 14. To maintain frame 14 in its closed position, locking means 62 is provided on outer tube 5. Locking means 62 includes a push button 620, locking bar 621 and catch portion 622.

Locking means 20 is provided on lower inner tube 2 for fixing tube 2 with respect to middle tube 1 in a position in which lower inner tube 2 is retracted within middle tube 1. Thus, in its locked position, locking means 20 extends through openings 10 and 15 respectively. When so locked, lower inner tube 2 causes spring 4 to become more compressed. This exerts a force on upper inner tube 7 to project outwardly from middle tube 1 which applies an opening force on frame 14.

Handle 9 is attached to the lower end of lower inner tube 2.

Figure 3:
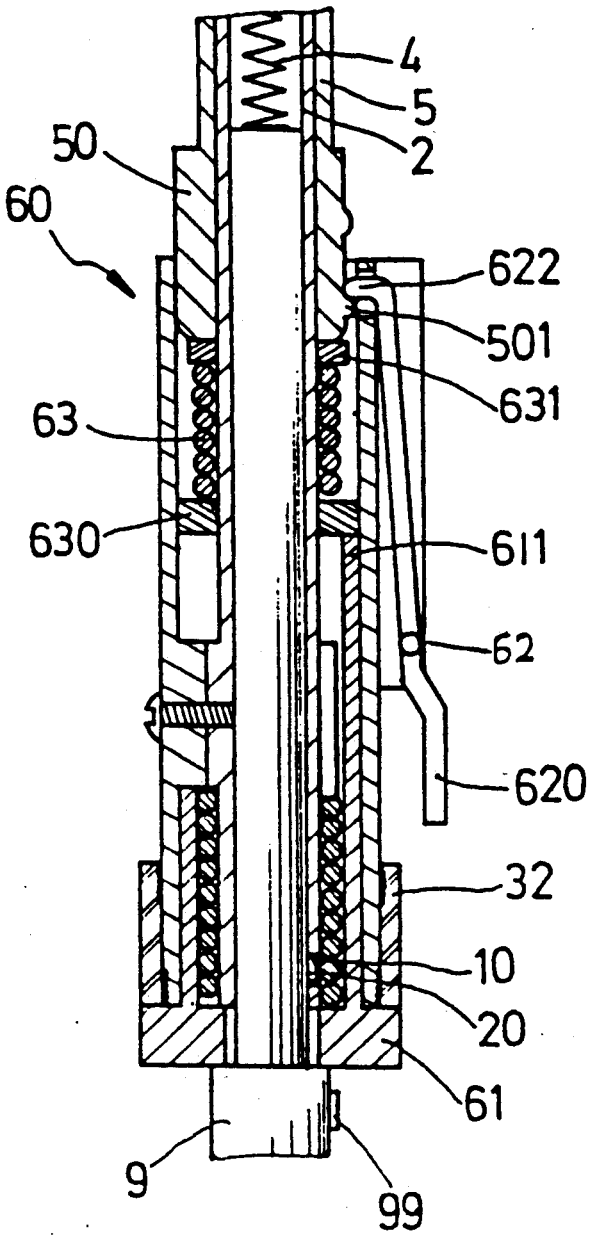
FIG. 3 illustrates the auxiliary mechanism of the present invention.
Figure 4:
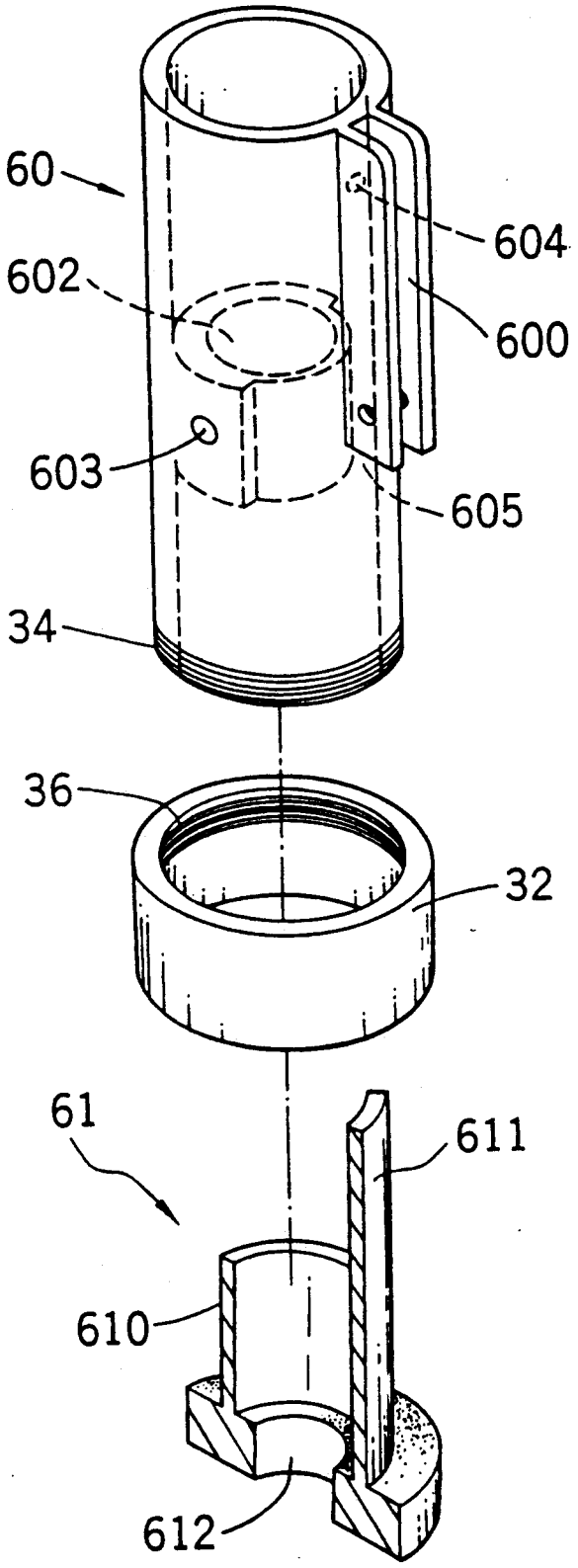
FIG. 4 is an exploded view of the auxiliary mechanism of the present invention.

Auxiliary mechanism 6, as shown in FIGS. 3 and 4, comprises a cylindrical tube 60, push rod 61, spring means 63, compression spring 64 and sleeves 50 and 32.

Cylindrical tube 60 has a hollow form and is provided integrally with a fixing part 601 on its inner wall for fixing tube 60 on the lower end of middle tube 1, an opening 603 on its side for strengthening the fixing of it by a screw on tube 1, a support 600 on its upper outer wall for supporting locking means 62 to pivot thereon, an opening 604 on its front end for catch portion 622 to pass through and screw threads 34 on the outer wall of its lower end.

Sleeve 50 is attached to the lower end of outer tube 5, provided with openings 501 and 502 on its upper wall for receiving catch portion 622 and has an outer diameter which is slightly smaller than the inner diameter of cylindrical tube 60 so that it can move into and out of cylindrical tube 60 freely.

Spring means 63 is coaxially provided over middle tube 1 inside cylindrical tube 60 and abutting against outer tube 5 and push rod 61. To make sure that spring means 63 will be touched by outer tube 5 and push rod 61 despite their difference in diameter, flat rings or washers 630 and 631 are coaxially provided over middle tube 1 and disposed between spring means 63 and push rod 61 as well as between spring means 63 and outer tube 5 respectively.

Push rod 61 has a hollow tubular form abutting against spring means 63 and handle 9 and includes a main portion 610, pushing portion 611 and an opening 612 adapted for push rod 61 to be able to slide over outer tube 5 (and also over fixing part 601) through space 605 which is provided between the outer wall of fixing part 601 and the inner wall of cylindrical tube 60.

Sleeve 32 is slidably provided over cylindrical tube 60 and has screw threads 36 on the inner wall of its front end for engaging with screw threads 34 of cylindrical tube 60. When engaged with each other, screw threads 36 and 34 serve to elongate cylindrical tube 60 so that it will abut on handle 9, thus preventing handle 9 from moving downward relative to shaft 19 freely. The umbrella can, therefore, be used as a walking stick.

Figure 5:
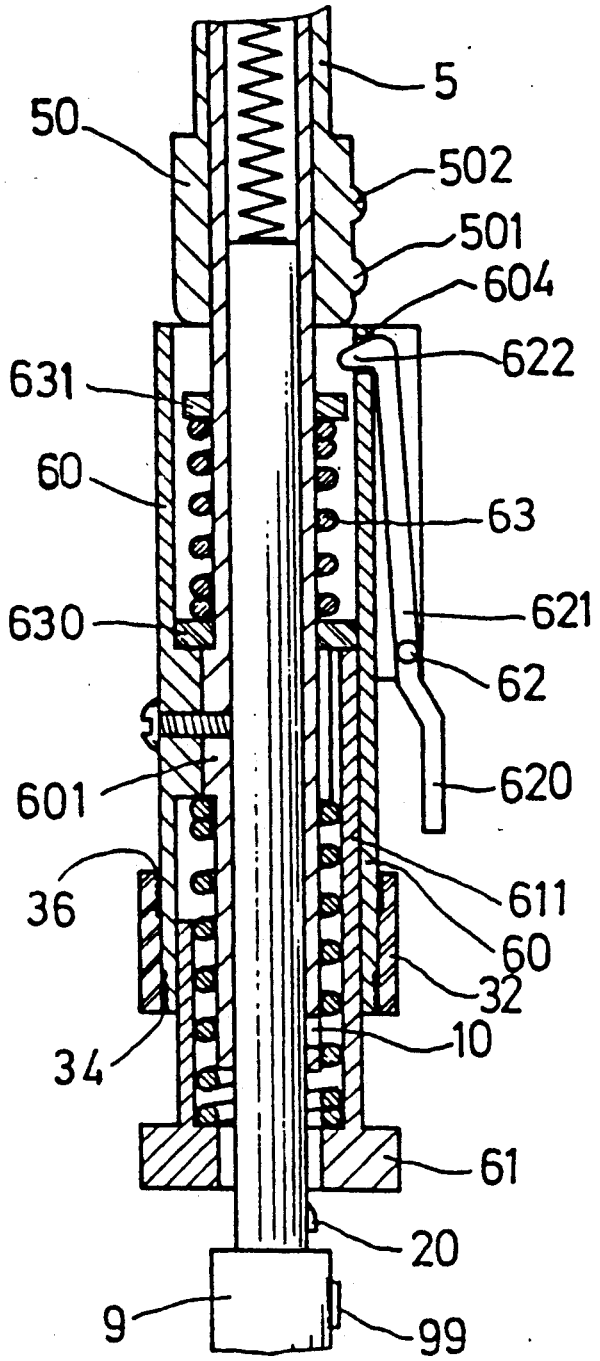
FIG. 5 illustrates the present invention at the first step of operation.

As shown in FIGS. 5 and 3, to open the umbrella, the first step is to compress spring 4 by pushing handle 9 with respect to the top portion of shaft 19 until locking means 20 fixes the position of tube 2 relative to tube 1. The second step is to deactuate locking means 62 to get catch portion 622 out of opening 502 by pressing button 620.

When locking means 62 is deactuated, spring 4 will drive tube 7 outwardly, thereby causing ribs 11 to pull stretchers 70 and 71 and making outer tube 5 to move upwards towards notch 12, thus getting the umbrella opened. Meanwhile, spring means 63 will also give outer tube 5 a thrust, thereby helping get the canopy unfolded quickly and the opening of the umbrella accelerated.

Figure 6:
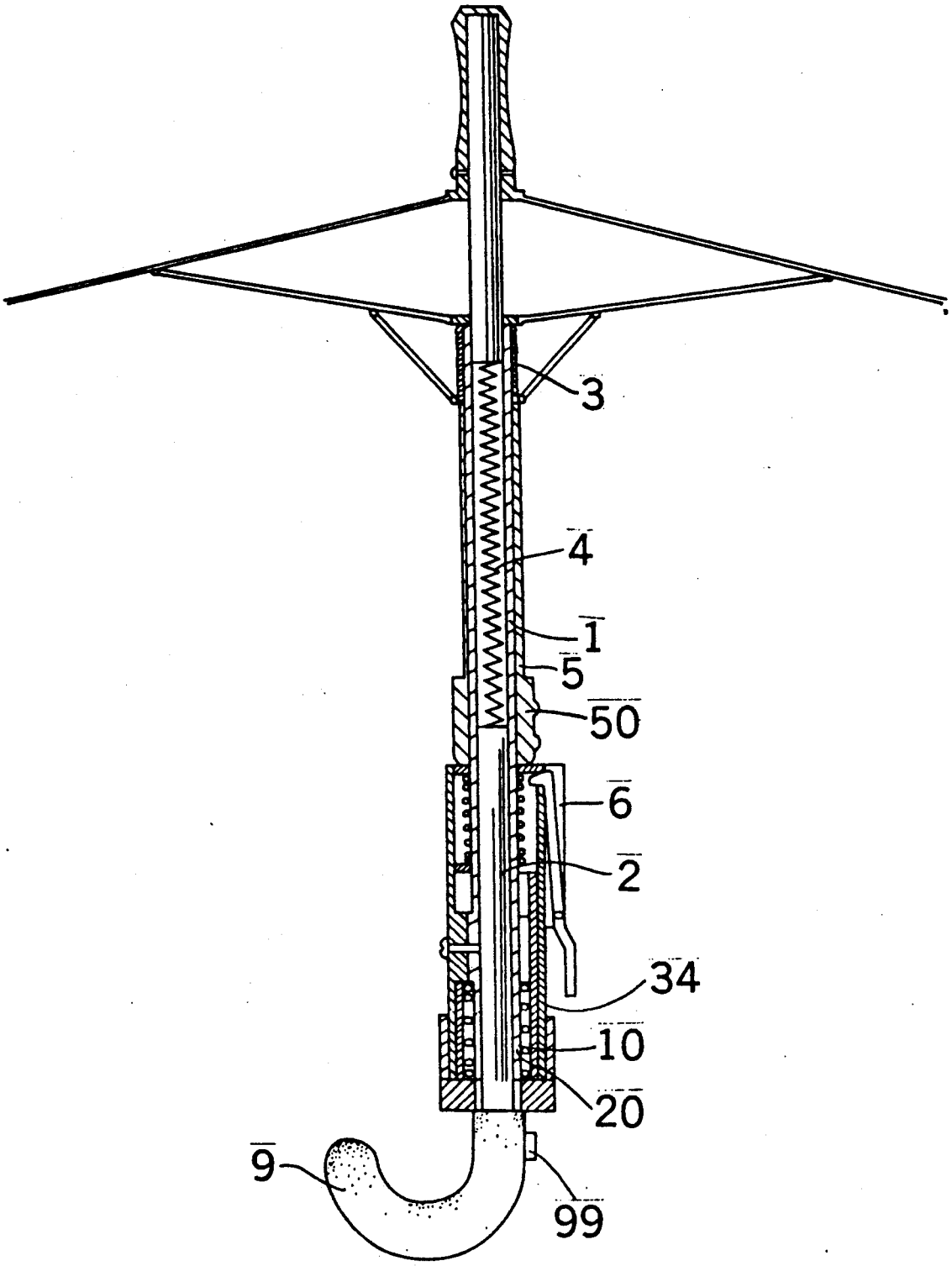
FIG. 6 illustrates the present invention at the second step of operation.

When the umbrella is opened, spring 3 will become compressed with respect to its natural position while the force applied to the end of middle tube 1 by spring 4 will be so reduced that it will be smaller than the force of spring 3. Now to close the umbrella, as shown in FIG. 6, it is only necessary to deactuate locking means 20 by pressing button 99, in which locking means 20 will come off opening 10, thus releasing tension on spring 4 and causing spring 3 to expand or return to its original shape, thereby separating notches 12 and 13 cause the umbrella to close.

When the umbrella is closed, sleeve 50 will also slide downwards to its original position, letting catch portion 622 reenter opening 502 and making re-opening of the umbrella possible. Besides, because of opening 501 which is longitudinally provided in alignment with opening 502 on sleeve 50, catch portion 622 can be sure to enter either of the openings for immediate reopening of the umbrella even there is a wind blowing, and when catch portion 622 enters a most suitably located opening, the umbrella can also close tightly.

Compression spring 64 is provided over lower inner tube 2 and contained between fixing part 601 and the lower inside end of push rod 61 for returning push rod 61 to its original position abutting against handle 9 after locking means 20 is deactuated. Compression spring 64 has a smaller elastic coefficient than that of spring means 63.

When cylindrical tube 60 is fixed on the lower end of middle tube 1, its fixing part 601 and elongated portion towards handle 9, so adapted, also serve to protect lower inner tube 2 from bending easily.

While a preferred embodiment of the invention has been illustrated and described, it is apparent that obvious modifications and variations can be made without departing from the scope of the invention. It is therefore intended that all such changes and modifications be included within the scope of the appended claims.

What is claimed is:

1. An improved self-opening and self-closing umbrella comprising a canopy, a conventional self-opening and self-closing frame formed of interconnected ribs, first and second stretchers, a telescoping shaft including a middle tube, an outer tube slidably disposed over said middle tube, an upper inner tube and lower inner tube longitudinally offest and slidably disposed inside said middle tube, a first notch provided at an upper portion of said upper tube and pivotably connected to said ribs, a second notch provided at an upper portion of said middle tube and pivotably connected to said first stretcher, a third notch provided at an upper portion of said outer tube and pivotably connected to said second stretcher, a first spring coaxially disposed over said shaft between said second and third notches, said first spring being compressed when said ribs and stretchers spread so as to bias said ribs and stretchers against spreading, a second spring provided between said upper and lower inner tubes and having ends abutting against the ends of said upper and lower tubes for biasing said upper tube away from said middle tube so as to spread said ribs and stretchers, first locking means for releasably fixing said outer tube with respect to said middle tube in a position in which said ribs and stretchers are not spread, and second locking means for releasably fixing said lower inner tube with respect to said middle tube so as to increase the compression of said second spring, the force exerted by said second spring on said upper inner tube being stronger than the force exerted by said first spring on said middle tube when said second locking means is actuated and being weaker than the force exerted by said first spring on said middle tube when said second locking means is deactuated so that when said first and second locking means are both actuated and said first locking means is subsequently released, said second spring urges said upper inner tube and said outer tube upward with respect to said middle tube, compressing said first spring to enable subsequent extension to close the umbrella when said second locking means is subsequently deactuated, a handle attached to an lower portion of said lower inner tube, and an auxiliary mechanism including:

a cylindrical tube having a hollow form and integrally provided with a fixing part on the inner wall of its center for fixing said tube on the lower end of said middle tube, a support on its upper outer wall for supporting said first locking means to pivot thereon, screw threads on the outer wall of its lower portion, and a semi-circular space between its inner wall and the outer wall of said fixing part, spring means coaxially provided over said middle tube and between said outer tube and said fixing part, a push rod having a tubular hollow form slidably provided over said fixing part and shaft and abutting on the ends of said spring means and said handle, serving to compress said spring when said handle being pushed relative to said shaft for the opening of the umbrella, in which said spring will help urge the umbrella to open quickly and fully when said spring means is decompressed as a result of the deactivation of said first locking means, a first sleeve provided with a plurality of longitudinally aligned openings on its upper wall and fixed to the lower end of said outer tube, a second sleeve slidably provided over the lower portion of said cylindrical tube and having screw threads on the inner wall of its front end for engaging with said screw threads of said cylindrical tube; when these two sets of screw threads being engaged with each other, said second sleeve will stand abutting against said handle and serve to prevent said handle from moving downward relative to said shaft so that the umbrella can be used as a walking stick, a flat ring or washer coaxially provided over said middle tube and between said spring means and said push rod and adapted to allow the end of said spring to be touched by the end of said push rod despite of the fact that they are different in diameter; same flat ring is provided between said spring and said outer tube for the same purpose, a compression spring provided over said lower inner tube and between said fixing part and the lower inside end of said push rod for returning said push rod to its original position abutting on said handle after said second locking means being deactuated.

2. An improved self-opening and self-closing umbrella as defined in claim 1, wherein said fixing part and the elongated portion of said cylindrical tube towards said handle are so adapted that they also serve to protect said lower inner tube from bending easily.

3. An improved self-opening and self-closing umbrella as defined in claim 1, wherein said first locking means comprises a locking bar, a catch portion and a push button; when said catch portion enters one of the openings on said first sleeve, the umbrella cannot open, and when it enters a most suitably located opening, it also serves to make the umbrella to close tightly.

4. An improved self-opening and self-closing umbrella as defined in claim 1, wherein said compression spring has a weaker elastic coefficient than that of said spring means.

* * * * *